US009472171B2

(12) United States Patent
Compani-Tabrizi

(10) Patent No.: US 9,472,171 B2
(45) Date of Patent: Oct. 18, 2016

(54) COMPANI FINGERBOARDS FOR STRINGED MUSICAL INSTRUMENTS

(71) Applicant: Behrooz Compani-Tabrizi, Laguna Hills, CA (US)

(72) Inventor: Behrooz Compani-Tabrizi, Laguna Hills, CA (US)

(73) Assignee: BEHROOZ COMPANI-TABRIZI, Laguna Hills, CA (US)

( * ) Notice: Subject to any disclaimer, the term of this patent is extended or adjusted under 35 U.S.C. 154(b) by 137 days.

(21) Appl. No.: 14/306,311

(22) Filed: Jun. 17, 2014

(65) Prior Publication Data

US 2015/0082966 A1 Mar. 26, 2015

Related U.S. Application Data

(60) Provisional application No. 61/880,271, filed on Sep. 20, 2013.

(51) Int. Cl.
*G10D 3/06* (2006.01)

(52) U.S. Cl.
CPC ..... *G10D 3/06* (2013.01)

(58) Field of Classification Search
CPC ..... G10D 1/08; G10D 3/06; G10D 3/00; G10D 3/04; G10D 3/14; G10D 3/143; G10D 1/00
USPC ..... 84/267, 290, 293
See application file for complete search history.

(56) References Cited

U.S. PATENT DOCUMENTS 3,478,631 A * 11/1969 Fisher ..... 84/293
4,534,260 A * 8/1985 Burrell ..... 84/293
6,034,310 A * 3/2000 Kolano ..... 84/293
6,114,618 A * 9/2000 Anke ..... 84/314 R

* cited by examiner

*Primary Examiner* — Kimberly Lockett

(57) ABSTRACT

Conventional stringed musical instrument fingerboards are constructed with a constant longitudinal slope, relative to the string, along the fingerboard's length direction. Fingerboards with variations in their slope along their length direction could improve playability by shortening the string-to-fingerboard distances. A variable slope fingerboard is suggested to improve playability at locations close to the bridge.

8 Claims, 1 Drawing Sheet

COMPANI FINGERBOARDS FOR STRINGED MUSICAL INSTRUMENTS

BACKGROUND OF THE INVENTION

1. Field of Invention

This invention is related to the shaping of the fingerboards of stringed musical instruments, such as, but not limited to guitars, violins, cellos, basses, banjoes, mandolins, tars, ouds and lutes.

2. Description of the Related Art

The fingerboard is the neck or usually a strip made of material (e.g., wood) glued on the neck of a stringed musical instrument against which the strings are pressed to produce different musical notes. Fingerboards are also called fretboards in fretted instruments.

The present stringed musical instrument fingerboards are constructed with a single constant slope that may be adjustable but does not vary along the length of the fingerboard. The present fingerboard constructions make the string-to-fingerboard distances for many of the higher pitched notes unnecessarily larger than required causing hardship in playability. Mitigation of this hardship is the accomplishment of this invention.

BRIEF SUMMARY OF THE PRESENT INVENTION AND JUSTIFICATIONS

The maximum amplitude of vibrations of a string with fixed end points occurs in the middle of the string and corresponds to the principle frequency (e.g., the longest wavelength). In a stringed musical instrument, the global maximum amplitude of vibrations, for all possible playable notes on a string, occurs at the middle of the open strings. In conventional instruments this maximum amplitude dictates and sets the minimum constant angle of the fingerboard with the stretched strings. This minimum and constant angle is selected by the luthier to simultaneously maximize ease of playability but avoid or minimize buzzing sounds.

Pressing the string against the fingerboard at higher positions shortens the string vibrating length and produces higher pitched notes. For the higher and higher notes the maximum amplitude of vibrations become smaller and smaller and the angle between the pressed string and the fingerboard becomes larger.

Finally, immediately after a string is struck it settles into standing wave vibrational modes that are symmetric with respect to the middle of the string. This suggests that the angle of the fingerboard with the string could also be made symmetric about the same point.

These facts suggest that past the string midpoint one can construct fingerboards with continuous or abrupt slope changes (i.e. upward bends towards the string) in the longitudinal direction, so as to shorten the string-to-fingerboard distances and still avoid buzzing. A curved fingerboard was suggested by Alan Robert Fisher (U.S. Pat. No. 3,478,631) such that the angle between string and fingerboard stays constant at any point when the string is pressed against the fingerboard. A Compani fingerboard design is different from Fisher fingerboards in three respects.

1. Fisher's fingerboard is longitudinally curved and its longitudinal slope varies continuously. In the Compani construction the longitudinal slope is constant from the nut to a point along the fingerboard after which it changes to a different constant value. The slope variation is a single discrete jump.

2. Fisher's construction keeps a constant angle between the pressed string and fingerboard at any point along the fingerboard. In the Compani construction this angle changes along the fingerboard in a way as to accommodate short string to fingerboard distances.

3. Modeling shows that, when by necessity the open string to fingerboard distance is optimized by setting the action in a stringed musical instrument, Fisher fingerboards have larger string to fingerboard distances compared to Compani and traditional straight fingerboards.

Kolano (U.S. Pat. No. 6,034,310) suggests a fingerboard with an adjustable fingerboard axis. These fingerboards are known as adjustable neck or variable action fingerboard and are distinct from a variable slope or longitudinally curved fingerboards.

BRIEF DESCRIPTION OF THE DRAWINGS

On the drawings wherein like numerals refer to like and corresponding parts throughout the several views in FIGS. 1*a*, 1*b*, 1*c*, and 1*d* a fingerboard is shown therein to illustrate the invention.

DETAILED DESCRIPTION OF THE INVENTION

Figures 1A, 1B, 1C, 1D:
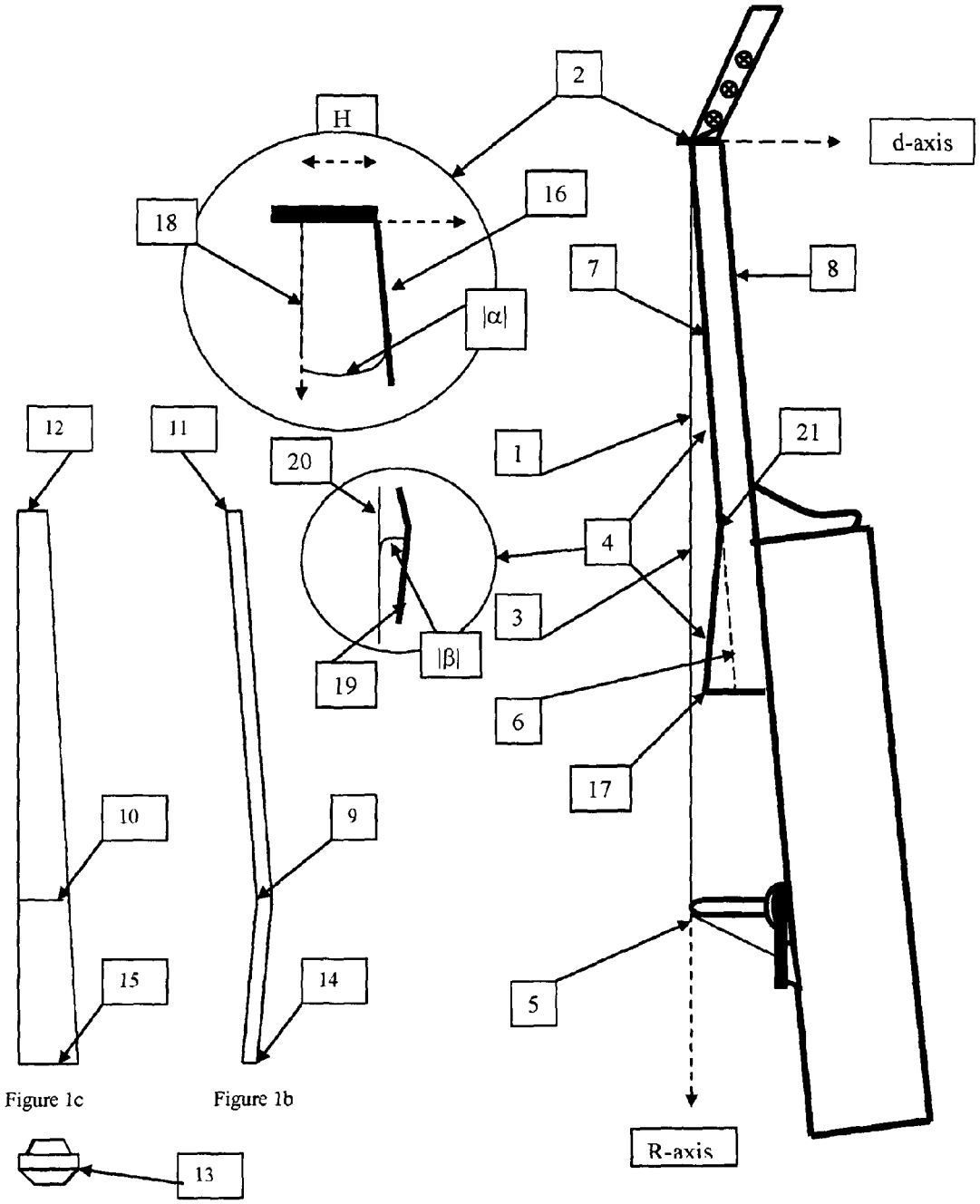
FIG. 1*a* is a side elevation view of a fretless stringed instrument having a fingerboard with a slope change in its longitudinal direction. Shown are a fingerboard 7 mounted to a neck portion 8 of a stringed musical instrument having strings 1, a nut 2, a string midpoint 3, and a bridge 5. Strings are suspended over a nut 2 and a bridge 5. A fingerboard face 7, at its end 17 near a bridge 5, is closer to strings 1 relative to a straight fingerboard indicated by dashed line 6. A magnified section illustrates a nut, and a region in its proximity, in which the magnitude of the angle between the upper part of fingerboard 16 and a string 18 is marked as $|\alpha|$. A magnified region 4 shows a fingerboard region with a slope jump at a point 21. A magnitude of an angle between the lower part of a fingerboard 19 and a string 20 is marked as $|\beta|$. A double arrow shows the distance H of the contact point of string 18 from a fingerboard 16 at an origin of a coordinate system with its axis marked as d and R.
FIG. 1*b* is a side elevation view of a fingerboard similar to that of FIG. 1*a*. Shown are a top end 11, a point where the slope changes 9 and a bottom end 14.
FIG. 1*c* is a face elevation view of fingerboard of FIG. 1*b*. Shown are a top end 12, a point where the slope changes 10 and a bottom end 15.
FIG. 1*d* is a third perspective view of fingerboard in FIG. 1*b*. Bottom end of fingerboard is marked 13.

A fingerboard is proposed with two slopes, that is, a fingerboard that keeps a constant longitudinal slope from a nut to some point, referred to as top end, passed which its slope changes by a constant amount, referred to as bottom end. The proposed design is applicable to all musical instruments with laterally flat or laterally curved ("radius" or "arched") fingerboards. An equation for string to fingerboard distances in a coordinate system referenced in FIG. 1*a* establishes the invention. In this figure a coordinate system origin is placed at the intersection point between a string 1 and a nut 2. A positive R-axis is placed along a string direction pointing away from a nut 2 towards a bridge. A d-axis is placed perpendicular to a string in a plane containing a string 1 and a perpendicular from string 1 to a fingerboard.

In said coordinate system a general equation for Compani fingerboard-to-string distance D at a point R is $$D=R\cdot\tan(\alpha)+H,\ \text{If } R\leq t/2+b$$

$$D=R\cdot\tan(\beta)+(t/2+b)\cdot(\tan(\alpha)-\tan(\beta)+H,\ \alpha>\beta>-\alpha,\ \text{If } R>t/2+b$$

In this equation t is a distance from said nut to said bridge. b has a value within a range given by $-L1\leq b\leq L2$. Length b and its limits L1 and L2 are chosen by a luthier to control the location of the slope change on a fingerboard. Recommended values are L1=L2=b=0. α Is a small angle between top end of a fingerboard and said R-axis and for most instruments is less than 15 degrees. H is a distance from a fingerboard to a string at origin of said coordinate system. It is appreciated that the transition from one slope to another may be made abruptly or smoothly at R=t/2+b in a short distance. Three advantages are attributed to these fingerboards.

1. Improved functionality and playability due to short distances between the string and the fingerboard requiring application of less physical pressure by fingers.

2. Playing speed is increased as the string to fingerboard contact time is shortened.

3. Shorter distances between the strings and the fingerboard result in smaller string tension build up as string stretching is reduced when strings are pressed, resulting in a more playable instrument.

REFERENCES CITED

United States Patent Documents

U.S. Pat. No. 3,478,631 November 1969 Fisher Alan Robert 84-293

U.S. Pat. No. 6,034,310 March 2000 Kolano Josef 84-293

The invention claimed is:

1. A stringed musical instrument, comprising:

a nut for supporting a plurality of strings at a top end of the stringed instrument;

a bridge for supporting the plurality of strings at a bottom end of the stringed instrument; and a fingerboard situated between the nut and the bridge of the instrument, the plurality of strings suspended above the fingerboard, wherein the fingerboard includes:

a first portion with a first constant slope relative to the strings and along the strings direction, commencing at or near the nut and terminating at a first position on the fingerboard, and a second portion with a second constant slope relative to the strings and along the strings direction, commencing at or near the first position and terminating at a second position on the fingerboard.

2. The stringed instrument of claim 1, wherein the second portion of the fingerboard rises towards the plurality of strings suspended above the fingerboard.

3. The stringed instrument of claim 1, wherein the second portion of the fingerboard runs substantially parallel to the plurality of strings.

4. The stringed instrument of claim 1, wherein the first position is situated substantially closer to the bridge than the nut.

5. The stringed instrument of claim 4, wherein the fingerboard comprises a lateral convex cross-section.

6. The stringed instrument of claim 4, wherein the fingerboard comprises a lateral flat cross section.

7. The stringed instrument of claim 1, wherein the first position is situated substantially at a midpoint between the nut and the bridge.

8. The stringed musical instrument of claim 1, wherein the fingerboard is a fret board comprising a plurality of frets.

* * * * *